US009677338B2

(12) United States Patent
Braga et al.

(10) Patent No.: US 9,677,338 B2
(45) Date of Patent: Jun. 13, 2017

(54) DEVICE FOR LASER DRILLING

(71) Applicant: Faculdades Católicas, Sociedade Civil Mantenedora da PUC Rio, Rio de Janeiro (BR)

(72) Inventors: Arthur Martins Barbosa Braga, Rio de Janeiro (BR); Cicero Martelli, Ipanema (BR)

(73) Assignee: FACULDADES CATÓLICAS, ASSOCIACÃO SEM FINS LUCRATIVOS, MANTENEDORA DA PONTIFÍCIA UNIVERSIDADE CATÓLICA DO RIO DE JANEIRO-PUC-RIO, Rio de Janeiro (BR)

( * ) Notice: Subject to any disclaimer, the term of this patent is extended or adjusted under 35 U.S.C. 154(b) by 0 days.

(21) Appl. No.: 15/013,655

(22) Filed: Feb. 2, 2016

(65) Prior Publication Data

US 2016/0153240 A1 Jun. 2, 2016

Related U.S. Application Data

(63) Continuation-in-part of application No. 13/808,616, filed as application No. PCT/BR2011/000211 on Jul. 8, 2011, now abandoned.

(30) Foreign Application Priority Data

Jul. 8, 2010 (BR) ..... 1002337

(51) Int. Cl.
*E21B 7/14* (2006.01)
*E21B 7/06* (2006.01)

(52) U.S. Cl.
CPC . *E21B 7/14* (2013.01); *E21B 7/06* (2013.01)

(58) Field of Classification Search
USPC ..... 175/16, 424; 219/121, 7
See application file for complete search history.

(56) References Cited

U.S. PATENT DOCUMENTS 3,871,485 A 3/1975 Keenan
4,066,138 A 1/1978 Salisbury
(Continued)

FOREIGN PATENT DOCUMENTS

BR PI0806638-8 A2 9/2010

OTHER PUBLICATIONS

A. Mendes & T.F. Morse, "Specialty Optical Fibers Handbook", Chapter 22, pp. 671-696, Elsevier Publisher, 2007.

*Primary Examiner* — Kyle Armstrong
(74) *Attorney, Agent, or Firm* — Laurence P. Colton; Smith Tempel Blaha LLC

(57) ABSTRACT

A device for laser drilling, having: (a) a laser module (310), having a plurality of laser subsystems (200), each one of the laser subsystems (200) having an active optical fiber (240), wound in a shape of hollow coil and packaged inside a hollow cylindrical box (210), and at least one diode laser (220) mechanically connected perpendicularly to the hollow cylindrical box (210) and optically coupled to the core of the active optical fiber (240) wound and packaged inside the hollow cylindrical box (210), the laser module (310) having a tubular shape allowing cooling and drilling fluids to flow through the concentric hollow cores of the tubular laser module (310) and of the cylindrical box (210); and (b) an optical drill head (100), the optical drill head having an end (130) with orifices (110 and 120), and a body (140).

17 Claims, 5 Drawing Sheets

(56) References Cited

U.S. PATENT DOCUMENTS

| | | | | |
|---|---|---|---|---|
| 4,090,572 | A | 5/1978 | Welch | |
| 4,113,036 | A | 9/1978 | Stout | |
| 5,107,936 | A | 4/1992 | Foppe | |
| 6,365,871 | B1 | 4/2002 | Knowles | |
| 6,626,249 | B2 | 9/2003 | Rosa | |
| 6,755,262 | B2 | 6/2004 | Parker | |
| 6,870,128 | B2 | 3/2005 | Kobayashi | |
| 6,888,097 | B2 | 5/2005 | Batarseh | |
| 7,147,064 | B2 | 12/2006 | Batarseh | |
| 7,416,258 | B2 | 8/2008 | Reed | |
| 7,487,834 | B2 | 2/2009 | Reed | |
| 9,062,499 | B2 | 6/2015 | Braga | |
| 9,090,315 | B1 * | 7/2015 | Stone | G02B 6/3604 |
| 2007/0125580 | A1 | 6/2007 | Hall | |
| 2010/0044103 | A1 | 2/2010 | Moxley | |
| 2010/0078414 | A1 | 4/2010 | Perry | |
| 2012/0020631 | A1 * | 1/2012 | Rinzler | G02B 6/4402 385/109 |

* cited by examiner

DEVICE FOR LASER DRILLING

STATEMENT OF RELATED APPLICATIONS

This patent application is a continuation-in-part and claims the benefit of U.S. patent application Ser. No. 13/808,616 having a filing date of 7 Jan. 2013, which is the US National Phase of International Patent Application No. PCT/BR2011/000211 having an international filing date of 8 Jul. 2011, which claims priority on and the benefit of Brazilian Patent Application No. PI 1002337-2 having a filing date of 8 Jul. 2010.

BACKGROUND OF THE INVENTION

Field of the Invention

The present invention relates to the field of equipment for laser drilling, and more specifically to such equipment comprising an optical drill head and a laser module with embedded laser subsystems.

Prior Art

A solution for the problems associated to the use of conventional drilling equipment that employs drilling bits that comprise one or more cutting mechanical elements was the use of laser beams as a mean of drilling wells in the ground.

Thus, U.S. Pat. No. 3,871,485 teaches a drilling process using a laser beam wherein a laser beam generator connected to a voltage generator charged by drilling mud or other liquid that passes through a laser beam slot connected to the drill string is positioned in the wellbore and a crystal reflector is positioned inside the laser beam slot to reflect the beam in an elliptical pattern across the formation to be entered.

U.S. Pat. No. 4,066,138 teaches an apparatus to drill the ground assembled above the ground that drives downward a high power energy laser ring to drill a cylindrical orifice by fusing the successive annular regions of the extraction to be entered in a power level that smashes and ejects the orifice successive layers.

U.S. Pat. No. 4,113,036 teaches a laser drilling method and system to recover fossil fuels wherein a vertical bore is drilled in an underground formation; a laser beam is projected through the vertical bore and reflected horizontally from the orifice through the formation along an array of bores.

U.S. Pat. No. 4,090,572 teaches a process and apparatus for laser-treatment of geological formations where a laser beam is projected through a guide for the light beam in a wellbore along a beam guide providing enough laser energy to melt or vaporize formations under underground conditions.

Despite all advantages associated to the use of this drilling method, which is not based on the physical contact between the drill bit and the surface to be drilled, and that presents other advantages, such as a higher speed of penetration, lack of physical contact between the drilling bit and the surface to be drilled, and energy efficiency to name a few, the utilization of lasers to drill wells was not developed at trade levels in function of and due to the lack of lasers with minimal power needed for efficient and competitive drilling when compared to mechanical equipment.

Another problem that has limited the practical implementation of laser-drilling is the large dimension of conventional lasers, which makes impossible their insertion into the drilled wellbores. Another current limitation is the nonexistence of efficient (with low losses by confinement, high transparency, and control of susceptibility to nonlinear phenomenon induction) optical conductors (optical fibers) that allow the guidance of the laser light through long distances and in places with small dimensions and difficult access.

U.S. Pat. No. 5,107,936 teaches a hot-drilling process that employs laser beams as heat source in which the bore hole profile is melted by the heat source and, during the drilling process, the resulting molten rock is pressed against the surrounding sidewall of the well.

In the late 1990s and early 2000s compact and high power lasers became commercially available, and the interest in its utilization for well drilling was renewed. Despite the development of high power lasers (based on different types and active materials, for example, gas, dyes, semiconductors, crystal, optical fiber doped or not, etc.) the development of optical fibers (mono-mode, multi-mode and with several profiles of the cross-section, index of refraction, and materials) with high transparency, low confinement losses and control of nonlinearities constitute other motivating factors to use high intensity laser light for drilling.

With the use of optical fibers it is possible to guide the high intensity laser light to long distances (some tens of kilometers) and keep the laser light quality (temporal and special intensity and coherencies) in the fiber outlet sufficiently high, ensuring the delivery of high optical densities—a condition that increases the drilling process efficiency.

In this regard, the patent literature includes the following recent documents about the subject matter.

U.S. Pat. No. 6,365,871 relates to a laser drilling method through the tool as a nozzle (40), in a cavity that comprises the drilling bore (41) through the tool (40) with the laser (50), providing fluid with laser barrier properties in the cavity so, when the bore (41) is open for the cavity, the laser light passing through the bore (41) is incident over the fluid whereby the tool (40) transversal to the cavity from the bore (41) is protected from the laser light, and causing the fluid to not enter in the drilled bore (41) by laser during the drilling process. The apparatus to perform the method is also described.

U.S. Pat. No. 6,626,249 describes a drilling and recovery geothermal system that comprises a drilling rig having a riser with laser and radar perforation assembled in said elevator, drilling pipe, rotatory mirror assembled adjacent to the lower end of said drilling pipe and devices to establish vacuum adjacent to said lower end of the drilling pipe in order to remover and recover heat and drilling waste.

U.S. Pat. No. 6,755,262 relates to a well drilling apparatus that can be at least partially placed in a drilling well. The apparatus includes a plurality (bundle) of optical fibers. Light energy that is input at one end of each fiber is transmitted through all of them, leaving the bundle to impinge upon at least one lens. The focal lens contains a plurality of focal elements, each one of them arranged to receive the output light energy of at least one of the optical fibers in the bundle, focusing the combined light energy beam in order to break and melt rock.

U.S. Pat. No. 6,870,128 describes the well drilling method with laser beam, the method comprising guiding the laser beam inside a conduit, where the laser beam is guided through the conduit by internal reflectivity of said conduit, and extending the conduit inside the well, so that the laser beam exiting the conduit is guided over to the area in the well to be drilled. A system for drilling a well with a laser beam is also provided, the system comprising a device to guide the laser beam inside the conduit, wherein the laser beam is guided through the conduit by internal reflectivity of said conduit, and device to extend the conduit inside the well, so the laser beam exiting the conduit is guided to an area in the well to be drilled. The invention further provides an apparatus composed of a conduit that can be extended inside the well, and the surface inside the conduit, where the internal surface is reflective to the laser beam.

U.S. Pat. No. 6,888,097 B2 describes an apparatus for drilling holes in the lateral wall of a well, the apparatus including an optical fiber cable with an end for laser input and an end for laser output. A source of laser is connected to the end of the laser input and a laser head is connected to the end of the laser output. The laser head includes a laser control component to control at least a feature of the laser beam. Control elements in the laser head to control the movement and localization of the laser head are connected to the optical fiber cable. The laser head is protected in a slot that protects the optical fiber cable and elements as reflectors and lens to control the laser beam emitted by optical fiber cable there arranged, from the aggressive environment found in underground operations.

U.S. Pat. No. 7,147,064 describes a drilling apparatus to drill a well having a drilling bit set that includes a laser cutting assembly and a vacuum assembly. The vacuum assembly is adapted to collect gases generated by the laser cutting assembly near the drilling bit set during the drilling operation. A chromatographic analyzer can thus be applied to process the collected gases in order to determine features of the rock formation being drilled.

U.S. Pat. No. 7,487,834 describes a method for well drilling with a high power laser intended to provide a laser beam to the well production zone in order to perforate the casing, cement layer, and reservoir rock, generating high permeability lateral penetrations in the formation to increase gas and/or oil flow into the well. An optical fiber cable delivers the laser beam to the laser perforator positioned in the production zone. The cable is curved at an angle around 90 degrees and arranged in the desired beam orientation and profile. A cutting nozzle in the perforating end provides a cleaning flow to: 1) remove from the well droplets of molten metal, cement, and rock fragments that can block the laser beam; and 2) create a free pathway through the well liquids, allowing the beam to reach the target surface during perforating.

U.S. Pat. No. 7,416,258 describes equipment and a method to use lasers in order to break and drill rocks. A group of laser beams is steered in a controlled way by an electro-optical key onto locations at the rock surface, creating multiple holes and removing a layer of rock with the desired diameter. Only a single laser beam, irradiating about 1000 to 5000 W/cm$^2$, spalls the rock. Breaking consecutive layers of rock through an intermittent motion of the laser head, in a direction perpendicular to the surface just drilled, increases depth of the borehole.

US Patent Publication No. 20100078414 A1 relates to an apparatus for underground drilling having at least one optical fiber to transmit light energy from an energy laser source arranged above the ground towards an underground drilling location and a mechanical drill bit having at least one cutting surface and forming at least a light transmission channel aligned to transmit the light from at least one optical fiber through a mechanical drill bit using at least one light transmission channel. It is alleged the equipment developed is especially proper for non-vertical wells.

U.S. Pat. No. 9,062,499 of the same authors of the present document, describes an optical drill head (104) integrated to a laser drilling system. However, this patent does not describe details of said optical drill head.

It is important to highlight that even in the inventions that propose the use of optical fiber(s) to deliver high intensity laser light to the bottom hole of a well, there is no practical demonstration of this possibility when long lengths of fiber are considered (deep wells, i.e., >hundreds of meters). The main reason for this is the non-linear phenomenon induced during high intensity laser light propagation through long lengths of fiber, which is responsible for attenuating the guided light, degrading fiber transparency, and, depending on the energy density and/or peak energy inside the fiber, generating permanent damage in the optical fiber. This is a classic problem in the field of guided optics, and many research groups and companies have been making efforts to reduce or eliminate them. In this respect, see the summary by A. Mendes and T. F. Morse, "Specialty Optical Fibers Handbook", Chapter 22, pp. 671-696, Elsevier Publisher, 2007.

Among several laser technologies, it is important to highlight the optical fiber-laser development, where high intensity laser light is generated inside the optical fiber itself. This laser is compact and in general does not require cooling, even when operating with high intensities (≥1 kW). Furthermore, light intensity losses generated when coupling the laser outlet to the conducting optical fiber (responsible for guiding the high intensity laser light through long distances up to the region of interest) are now minimal, as, in the case of fiber lasers, there is a fiber-fiber coupling instead of one of fiber with free space.

Regarding the laser light wavelength, it is noted the commercial availability of high power lasers with various different wavelengths (from ultraviolet to infrared, depending on the active element and on the laser cavity design), and of lasers with tunable wavelength. This means that, depending on the material to be drilled, it is possible to use the drilling wavelength coinciding with the absorption range of this material. This significantly increases the process efficiency. Thus, during the drilling it is possible to select in real time the more appropriate laser light wavelength to the material being drilled. This is another technological advantage of laser drilling over the conventional mechanical systems employed today in the oil and gas industry.

Therefore, it would be advantageous that the art had one laser drilling equipment able to generate high intensity light in a downhole module with embedded lasers, such light being guided through optical fibers, along a distance short enough to avoid undesirable nonlinear effects, up to one optical drill head, such head being the mechanical component that supports optical fibers, provides geometrical control to high intensity light action and promotes the drilling system interface with the rock surface to be drilled.

Regarding the researched literature, no documents anticipating or suggesting the teachings of the present invention were obtained, so the solution here proposed has novelty and inventive step toward to the state of the art.

BRIEF SUMMARY OF THE INVENTION

Generally, the laser drilling equipment according to the invention comprises:

a) A laser module consisting of a set of laser subsystems that are optical fiber lasers, each one including active fibers, arranged in the shape of hollow coils and packed in a hollow cylindrical box, the excitation of the active fibers being performed by coupling the light emitted by a plurality of diode lasers whose outputs are coupled to optical fibers that feed light into the active fiber, diode lasers being connected more efficiently to the active fiber coils mounted in such a way to take advantage of the available space in the tubular laser module, allowing a cooling fluid, transparent in the wavelength of the light emitted by the fiber lasers, to flow through its internal core in order to efficiently refrigerate the embedded set of laser subsystems; and b) A mechanical component that is an optical drill head with a rigid and hollow body and an end of spherical shape, said head being provided with channel orifices for the connection of optical fibers or bundle of optical fibers with the optical drill head walls and with other open orifices to allow the drilling and cooling fluid, transparent in the wavelength of the light emitted by the fiber lasers, flowing through the core of the laser module and optical drill head assembly, to be released on the rock surface to be drilled, the optical fibers or bundle of optical fibers being derived from the laser module, where the fiber lasers responsible for high intensity light generation are connected to the optical drill head through optical fibers, said laser module and the optical drilling bit being coupled to a drill string or flexible pipe.

For said optical drill head with spherical geometry, an angle $\alpha$ is determined between an imaginary line crossing the sphere's geometric center in a direction perpendicular to the symmetry axis of the tool and the plane where light beams leave the drill head at a maximum angle with the sphere's geometric center. This angle defines the maximum achievable inclination of the optical drill head and, consequently, the maximum slope that the well or wellbore can be drilled with the proposed laser drilling device.

Thus, the invention provides equipment for laser drilling where the laser module, with a set of embedded laser subsystems comprised of high power fiber lasers, is responsible for high intensity light generation that, through optical fibers, is guided up to an optical drill head, this being the mechanical component through which the laser generated energy, guided along optical fibers, leaves the device to interact with the rock formation at controlled angles. The optical drill head also provides geometrical control to high intensity light action and promotes the interface of the drilling system with the surface to be drilled.

The invention further provides equipment for laser drilling with a reduced number of moveable mechanical parts present in the drilling system.

The invention provides equipment for laser drilling that significantly reduces the need of drill string rotation, with large operational advantage.

The invention also provides equipment for laser drilling able to monitor the drilling process in situ, with increased process control.

The invention further provides equipment for laser drilling able to drill different materials without the need to substitute the drill bit.

The invention also provides equipment for laser drilling where, depending on the material to be drilled, different wavelengths of the laser light are triggered to increase the drilling efficiency.

The invention further provides equipment for laser drilling where it is possible to use different modes of operation such as continuous or pulsed.

The invention also provides equipment for laser drilling with reduced maintenance costs.

The invention further provides equipment for laser drilling where the tectonic movement risks, caused by drilling are reduced due to the lack of contact between the optical drill bit and the surface to be drilled.

The invention also provides equipment for laser drilling where the drilling system dimensions are lower and therefore it is also lighter than traditional systems.

The invention further provides equipment for laser drilling where generally it is possible to maintain higher control of the drilling depth and the drilling direction.

The invention also provides equipment for laser drilling where due to mechanical strength increase of the drilled well walls against walls surface vitrification, it is reasonable to speculate on reducing the need for casing pipes during in the well.

The invention, due to the spherical geometry of the optical drill head, further provides equipment for laser drilling that allows control of the drilling direction, which can reach a maximum inclination characterized by the angle $\alpha$, defined here as the maximum angle of operation.

The invention also provides equipment for laser drilling where individual control of each one of the fiber lasers, embedded in the laser module, that can be turned off and on independently, allows selecting the sections of the optical drill head that will be illuminated and interact with the rock formation, thus steering the laser drilling device towards a preferred direction for the drilled borehole.

These and other objects of the invention are immediately appreciated by those skilled in the art and by companies with interests in the segment, and will be described in sufficient detail to be reproduced in the following description.

DETAILED DESCRIPTION OF PREFERRED EMBODIMENTS

The examples herein shown aim only to illustrate one of the numerous ways of performing the invention, however, without limiting the scope of the same.

Thus, the invention relates to equipment for laser drilling, able to generate high intensity light in a downhole laser module with embedded lasers, such light being guided through optical fibers, along a short distance, up to one optical drill head, such head being the mechanical component that supports optical fibers, provides geometrical control to high intensity light action and promotes the drilling system interface with the rock surface to be drilled.

The equipment for drilling oil wells according to the invention, composed of laser module and optical drill head, can be directly integrated to drilling conventional systems and can operate at any depth.

Figure 3:
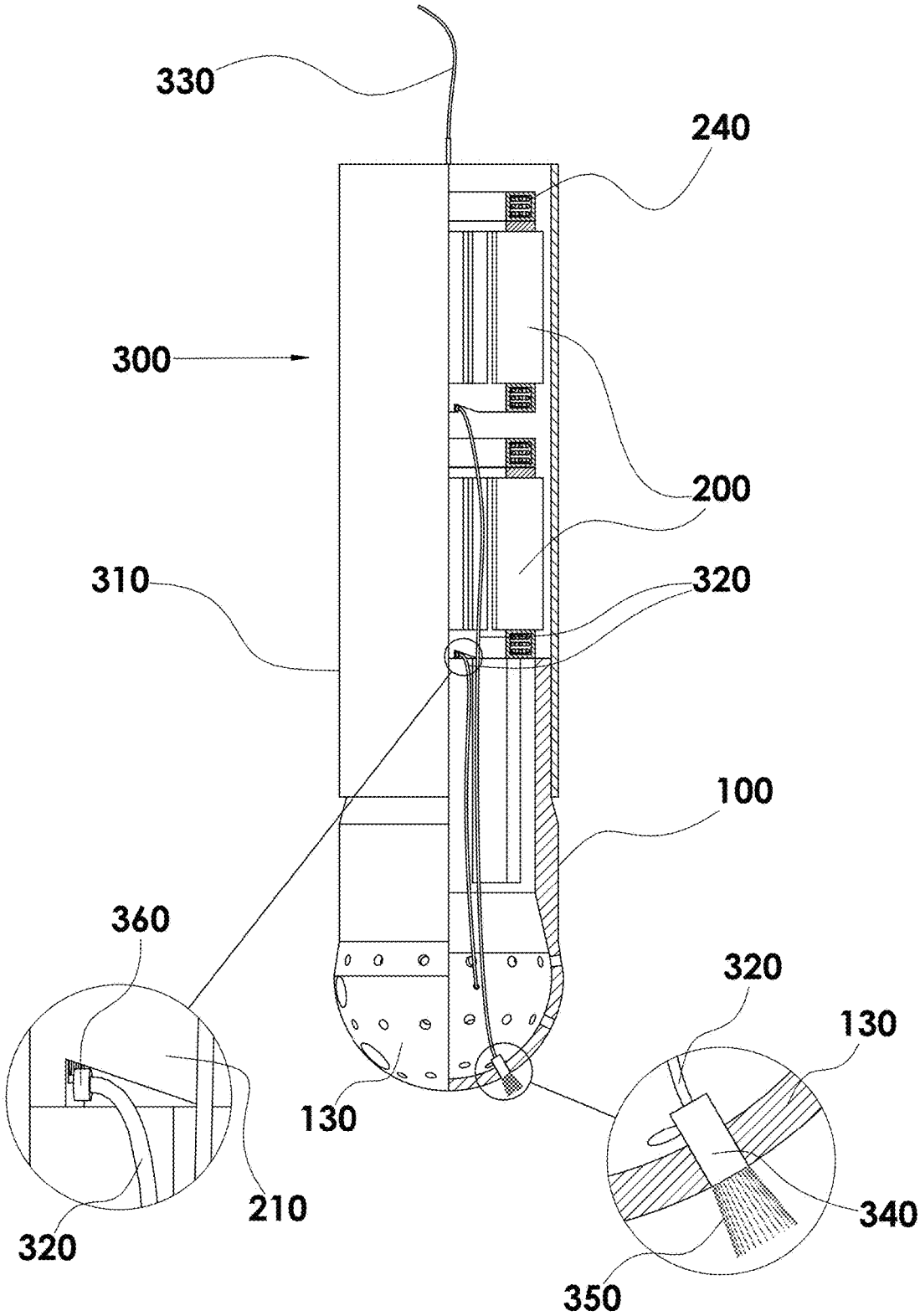
FIG. 3 is a general half-section view of the device, with the assembly comprising the laser module and optical drill head.

The laser module, located in the bottom hole assembly is energized from the drilling rig through an electric cable, said module consisting of a plurality of laser subsystems, those being a particular construction of a high power fiber laser that generates the light with high intensity for drilling, being coupled at the top end to a conventional drill string or flexible pipe system, and at the lower end to the optical drill head, as can be seen in FIG. 3. The light emitted by the laser subsystems is guided up to the optical drill head through optical fibers.

The use of fiber optics to carry light energy from the laser module to the optical drill head allows the idealization of virtually any geometric shape for the end of the optical drill head.

According to the present invention concept, for each point where laser light interacts with the rock to be drilled, there is an optical fiber providing such high intensity laser light. Associated to each fiber there is one or multiple laser subsystems combined to produce the energy for drilling. All laser subsystems used in the drilling process are embedded in the laser module, which is a pipe whose outer diameter is compatible with those of pipes employed in conventional drill strings, but with internal modifications needed to pack and mechanically support a plurality of high power laser subsystems. Therefore, the laser subsystems and the cylindrical tubular structure form the laser module. The main function of this module is generating and supplying high intensity laser light for the optical drill head.

FIG. 3 shows the laser module coupled to the optical drill head.

Advantageously, the modular design of the equipment of the invention eases the implementation of the same once each one of its parts can be developed and tested independently. For example, it is possible to firstly develop a laser subsystem that can operate inside a cylinder in the pressure and temperature conditions found in the bottom of a well while still being able to generate enough light energy for drilling the rock formation. With this laser subsystem (that provides only one active point where laser light leaves the device to interact with the rock to be drilled) one estimates the effective area of light interaction with the rock and, from there, it is possible to determine the number of active points in the optical drill head, which is directly related to the number of laser subsystems that will be embedded in the laser module.

In addition, it is possible to evaluate constructive details of the fiber coupling to the laser and the fiber to the optical drill head.

Further advantageously, (i) the fact of having the laser embedded in the drilling device significantly reduces the drilling system complexity; and (ii) problems with the optical fiber mechanical fragility, loss of optical properties due to hydrogen diffusion, in the case of silica fibers, as well as limitation with the power level transmitted over long distances (responsible for non linear phenomenon induction), etc. are eliminated.

On the other hand, it is necessary that the lasers, which will be embedded in the laser module of the device, support the operation in unconventional conditions, high external hydrostatic pressures and increased temperatures. In addition, they must be packed in reduced spaces such as the interior of the drill pipe. Obviously, even under these conditions, the laser subsystems must be able to generate enough energy to promote an efficient drilling of rocks.

Figure 2:
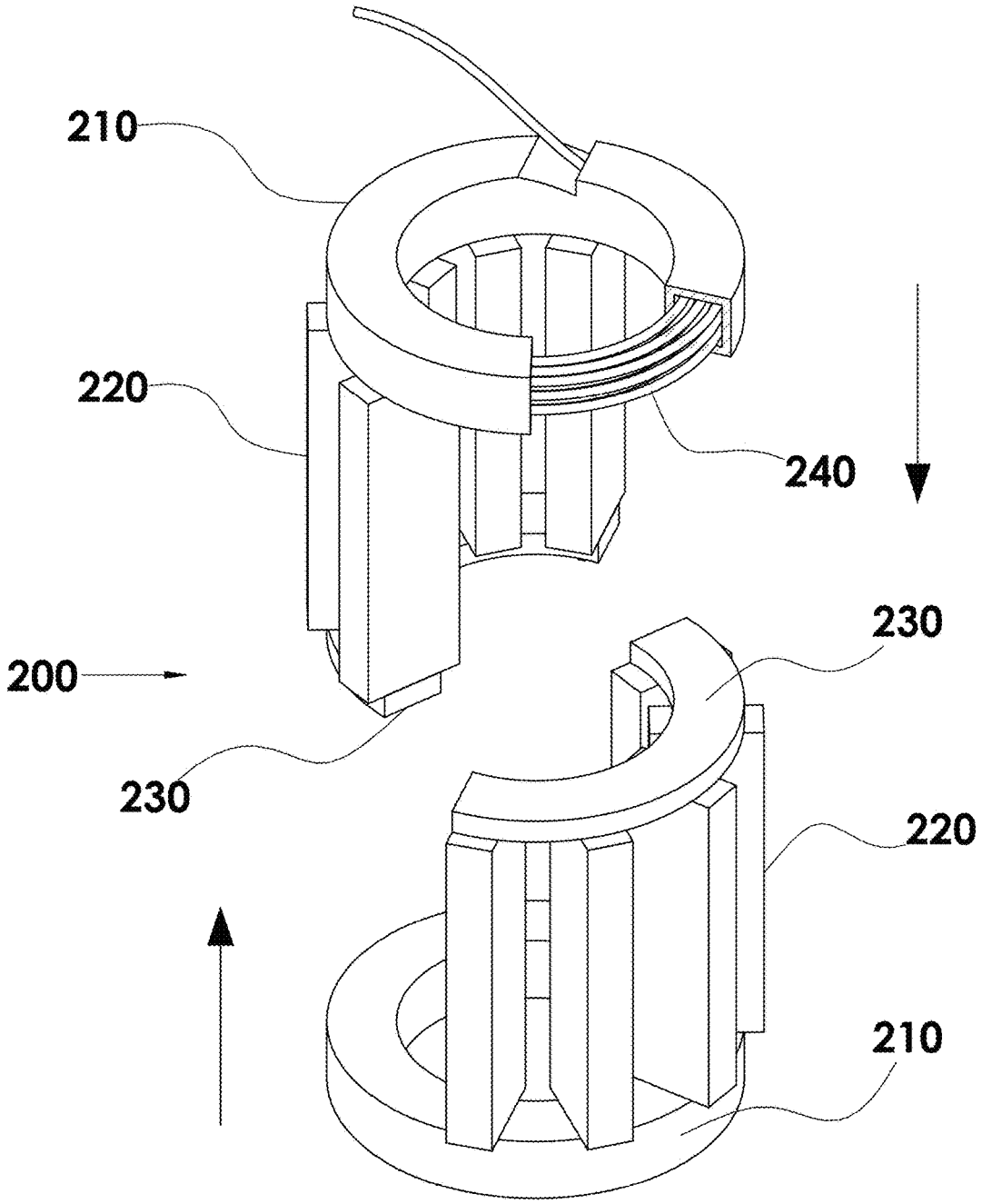
FIG. 2 is a three-dimensional view of the embedded fiber laser subsystem in the laser module of the laser drilling device of the invention.

Based on these premises involving operation conditions and the needed levels of energy, the research work of the Applicants has led to the development of a laser subsystem encapsulated in the shape of a ring or coil that is presented in FIG. 2. It consists of a high power fiber laser, the laser being pumped by diode lasers. The light emitted by many diode lasers is combined to excite the optical fiber-laser active medium, a rare earth doped optical fiber, the active optical fiber, and then produce laser light with high intensity and high coherence, both in space and time, which is a sine qua non condition to efficiently focus the light in the fiber outlet.

The ring or coil format where pumping diode lasers are positioned over a semicircular ring surface brings a modular feature to the laser subsystem design. This allows the lasers to be stacked on top of each other in the core of the tubular structure forming the laser module, according to FIG. 2 and FIG. 3.

The ring format also enables the drilling and cooling fluid to circulate through the laser subsystems, which, besides bringing a compatibility with other parts of the drilling system, where a fluid circulates inside the drill string, contributes to the cooling of the laser subsystems.

The light generated by lasers can be guided up to the optical drill head by means of diffractive optical fibers whose properties are ideal to transport high densities of energy. These fibers have also high damage resistance in its interfaces.

It is important to highlight that the idea of using optical fiber lasers pumped by diode lasers is simply motivated by the optical quality of the light emitted by this type of lasers. An alternative for the present invention is to connect the diode lasers directly to the fiber and use the light produced by them to drill, without the need to set up a fiber laser.

The optical drill head, in general, with specific dimensions and shapes adequate to each drilling process, is formed by a metallic structure where optical fibers that transport the high intensity laser light are coupled in the internal wall of said drill head and provide high intensity light for drilling.

The optical drill head can be configured in any dimensions or shape needed for different drilling campaigns. The end shape of the optical drill head will depend on the type of soil or rock to be drilled, the type of drilling to be performed, the drilling diameter, the well or bore depth, and the resulting inclination and/or well or bore angle.

Figure 1:
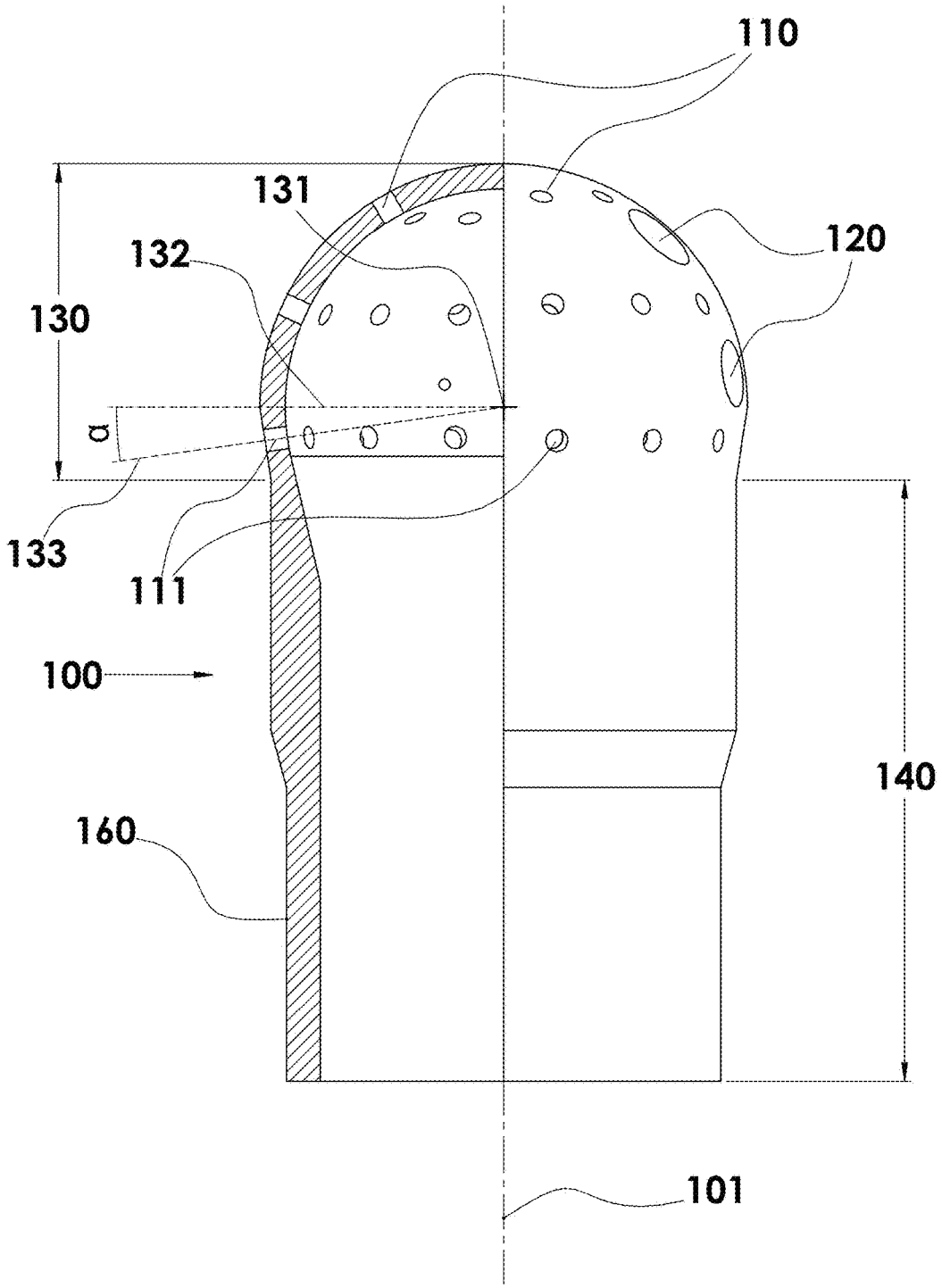
FIG. 1 is a quarter-section view of an optical drill head of the laser drilling device of the invention showing the spherical end of the head and body of the same.

The optical drill head shown in FIG. 1 is an example of the device for drilling wells with diameter of 8". Each channel orifice, where optical fibers are fixed, is aligned towards the direction normal to the spherical wall of the drill head. This ensures that the light beam leaving the device focuses perpendicularly to the rock surface to be drilled along the whole spherical surface of the drill head end.

The number of channel orifices to connect the fibers, i.e., points of interaction of the laser light with the rock to be drilled, depends on the drill bit superficial area and on the individual efficiency of each laser in the drilling process.

The drilling efficiency is given in a simplified manner by the volume of rock removed divided by the energy expended in the drilling process.

Two features of the present optical drill head design allow the direction control (steering) of the drilling process. The first one is through the shape of its end. As shown in FIG. 1 and further detailed in FIG. 5, by the controlling angle $\alpha$ (a constructive parameter), defined as the maximum angle of operation, the spherical symmetry of the drill head end allows the drill head to drill bores at an inclination of $\alpha$ degrees with respect to the drill head symmetry axis.

Figure 5:
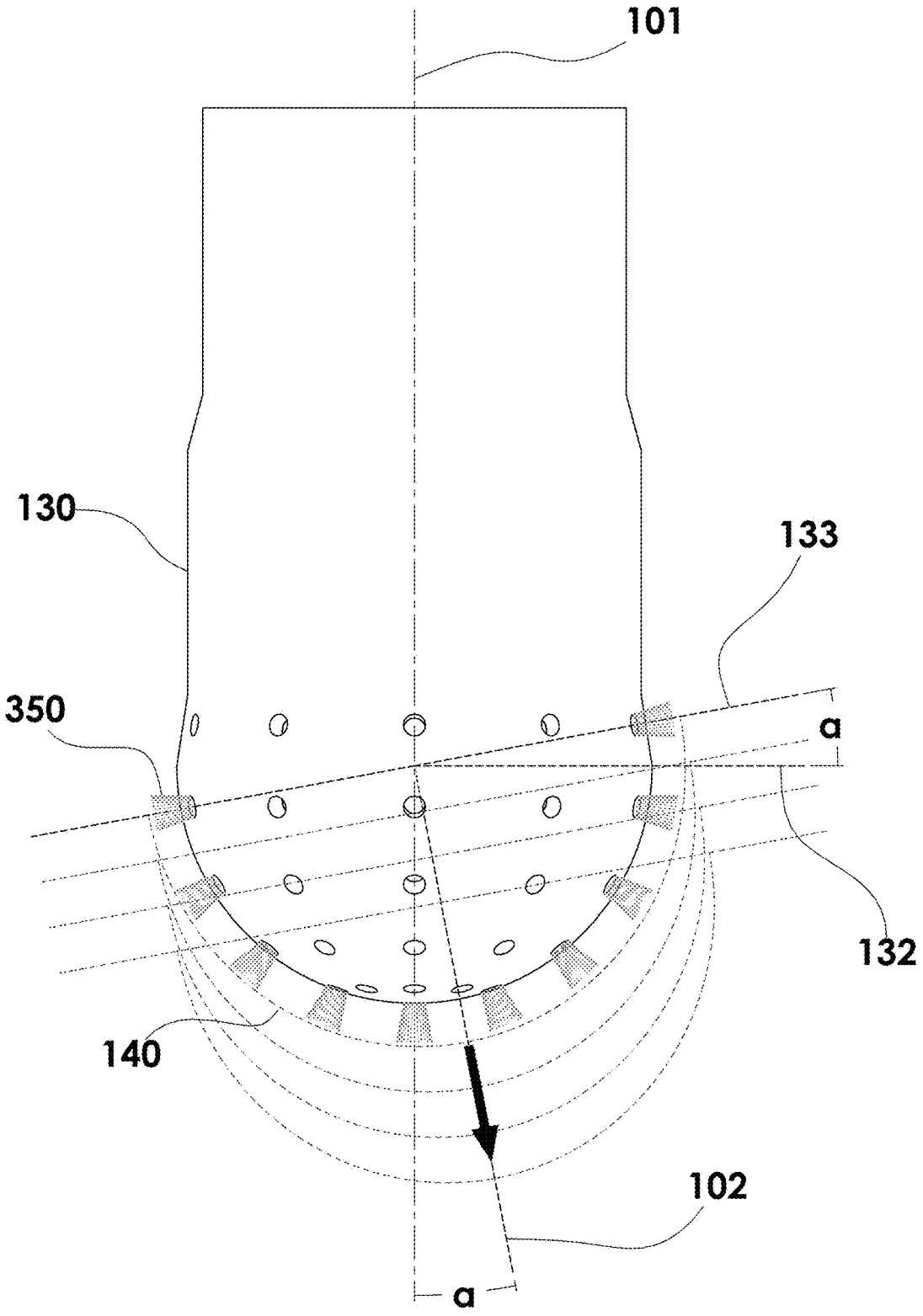
FIG. 5 is a schematic depiction of the directional laser drilling process.

The other feature that allows steering the optical drill head to produce inclined boreholes is related to the control individually provided to each one of the laser subsystems embedded in the laser module. These subsystems, through optical fibers connected to their outlets, feed the high power light beams that illuminate and interact with the surface to be drilled. By selectively turning off and on the laser subsystems that illuminate specific sections of the wellbore, one is able to control the direction towards which the optical drilling device must be steered in order to drill a borehole with a specified inclination and azimuth. This process is schematically depicted in FIG. 5, which illustrates the progressive advancement of the drill head through the inclined borehole.

Furthermore, the ability to drill rock in different directions allows this invention to be also employed in perforation operations, where lateral bores are drilled perpendicularly to the symmetry axis of the cylindrical borehole, penetrating into the rock formation and passing through the casing and cement layers, thus letting the reservoir fluid to flow into the production tubing and upwards to the top of the well.

The optical drill head design, as showed in FIG. 1, further contemplates the use of channels (orifices) for the drilling and cooling fluid to flow through them out of the device in order to clean and carry debris created by the drilling process.

EXAMPLE 1

Preferred Embodiment

The invention is described in the following by reference to the attached figures, without, however, limiting the same to the illustrated configurations.

FIG. 1 illustrates the optical drill head 100 of the equipment of the invention. In this figure, said drill head has an end 130 of any format, herein illustrated as spherical, this being a possible modality among others, and a tubular body 140.

Two types of orifices are present in the drill head 100 end 130. Orifices 110 and 111 are channels through which high power light beams leave the drill head to illuminate and interact with the rock surface being cut. They are employed for connecting optical fibers or bundle of optical fibers with the spherical wall of the drill head end. The second type of orifice 120 allows the drilling and cooling fluids that flow through the core of the drilling device to be released on the surface to be drilled and flow back, carrying debris produced by the drilling process, through the annulus formed by the device and the borehole wall.

The number of orifices 110 for optical fiber or bundle of optical fiber connections is defined taking into account the area on the rock surface illuminated by high power light beams emanating from each optical fiber or bundle of optical fibers, so that the whole spherical al surface of the drill head end 130 may play the intended role of drilling the surrounding rock formation.

The interior of the drill head 100 is hollow, enabling the passage of the optical fibers or bundle of optical fibers (not represented), which convey optical energy for drilling, and also the connections of said fibers to the channel orifices 110 and 111 through which high power light beams leave the device to illuminate and interact with the rock to be drilled. Along the hollow core, drilling and cooling fluids are also able to flow until released through leaky orifices 120 on to the surface to be drilled.

The angle $\alpha$, defined as the maximum angle of operation, has its vertex 131 at the geometrical center of the spherical drill head end 130 and is formed by imaginary lines that cross this center, one line 132 perpendicular to the symmetry axes 101 of the drill head and the other line 133 passing through the center of the circular orifice 111 where a light beam leaves the drill head end at a maximum angle with the symmetry axis 101 of the optical drill head.

FIG. 2 illustrates the laser subsystems used in the equipment of the invention.

The laser subsystems 200, which are the sources of high intensity light employed in the proposed drilling process, must be designed in a way to adapt to the geometric constraints imposed by the need to integrate the laser drilling device to conventional drill strings or flexible pipes. In particular, the laser subsystems must be packed inside a tubular body and also allow the drilling and cooling fluid to flow through them. To this end, the more appropriate architecture is that of optical fiber-lasers. In this type of laser, an active optical fiber, doped with a rare earth ion, constitutes the active medium. Optical fibers are flexible and can be wound forming a hollow coil, and this coil 240 can be packaged inside a hollow cylindrical box 210.

The excitation of the laser active medium, which is the doped optical fiber itself (the active optical fiber), is performed by coupling light emitted by diode lasers 220 to the core of the active fiber. These diode lasers 220 are also known in the literature as pumping diodes.

In the project presented in FIG. 2, a plurality of diode lasers 220 are perpendicularly connected to the active fiber 240 that is packaged inside the hollow cylindrical box 210, and further supported on their other end by a rigid plate in the form of a semicircular ring 230. This completely hollow assembly 200 forms a laser subsystem. By allowing a drilling and cooling fluid to flow through its hollow core, the geometric arrangement and design of the laser subsystem 200 shown in FIG. 2 brings an advantage by intensifying thermal dissipation of heat generated by the thermo-optical conversion process in the diode lasers (pumping diodes). This is of utmost importance to the drilling process in order to keep the diode lasers operating at their best efficiency in the often high-temperature environment of the wellbore.

In order to further ensure the proper temperature control of the laser subsystems, it is also possible to specify the composition and the temperature at which the cooling fluid is injected into the drill string.

As indicated by the arrows in FIG. 2, the geometric conception of the laser subsystem 200 further allows the packaging of two of the laser subsystems 200 on top of each other, making the assembly even more compact and robust.

The laser module is composed of a plurality of laser subsystems 200. The high power light generated by the fiber lasers are conveyed to the optical drill head (100) by optical fibers 320 (see FIG. 3), along a distance that can be short enough to avoid attenuation due to undesirable nonlinear effects.

Tens of laser subsystems 200, or as many as needed for efficient drilling, can be stacked along the hollow interior of the laser module 310 (see FIG. 3).

Each laser subsystem 200 is independently controlled, enabling different modes of operation to be employed in the drilling process, such as, for example, pulsed or continuous.

FIG. 3 shows the illustration of the equipment 300 concept of the invention where it can be noted: the optical drill head 100, the laser module 310 formed by a plurality of laser subsystems 200, the optical fibers 320 (only two optical fibers are shown in the drawing) connecting each laser subsystem 200 to a specific point inside the optical drill head 100, and an electric cable 330 that powers the laser subsystems 200. Each point of connection between an optical fiber 320 and the optical drill head 100 is a communication channel with the spherical end 130 of said drill head and is perpendicular to the rock surface to be drilled. The optical fibers 320 are connected to the head 130 of the optical drill head 100 by sealed connectors 340 with an appropriate optics and lenses system to focus the high power light beams 350 onto the rock surface. Thus, the optical fibers 320 provide high intensity light 350 directly over the rock surface. Each optical fiber 320 that guides light from the laser subsystems 200 to the optical drill head 100 is connected to an active fiber 240 packaged inside the hollow cylindrical box 210 by means of a sealed fiber optical connector 360.

Figure 4:
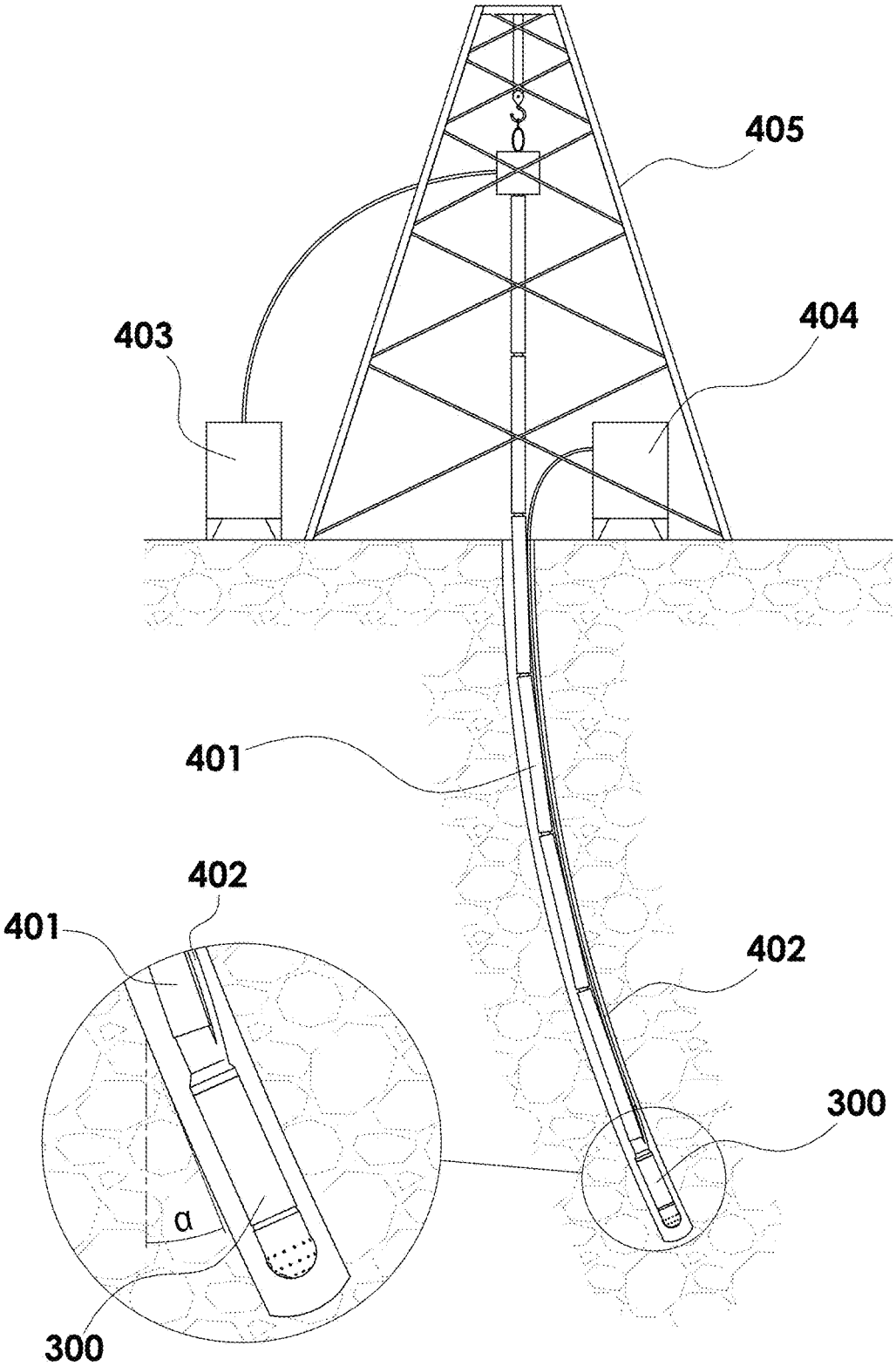
FIG. 4 is a general view of the laser drilling device in a borehole.

FIG. 4 shows a general view of the laser drilling device in a borehole. The equipment 300 concept of the invention is connected to a drill string or flexible pipe 401 through each a cooling and drilling fluid flows, returning and carrying debris through the annulus formed between the wellbore wall and the drill string or flexible pipe. The cooling, pumping, discard, and treatment system 403 for the circulating fluid is only schematically depicted. Electric power, generated by a controlled power source 404 on the top surface, at the drilling rig 405, is conveyed down hole to the laser drilling device 300 by an electric cable 402.

FIG. 5 schematically depicts the steering process of the laser drilling tool in order control the inclination of the borehole. By individually controlling the laser subsystems that are turned on, a specific area 140 of the rock formation, which corresponds to the end surface of the wellbore, is illuminated with high power laser light 350. In the example illustrated in FIG. 5, the illuminated area in front of the drill head has its axis of symmetry 102 defined by the angle $\alpha$, which is the same as the maximum angle of operation formed by lines 132 and 133. As the tool progresses into the borehole, and by keeping the same laser subsystems active, the illuminated area 140 advances continuously in the direction of line 102 thus creating a well with inclination $\alpha$. Other inclinations may be achieved by selectively turning on those laser subsystems 200 that will illuminate the desired areas of the rock formation. The case illustrated in FIG. 5 represents the maximum angle of inclination that can be achieved locally.

Thus, in one preferred embodiment, the current invention is a device for laser drilling, comprising:

a) a laser module 310, comprised of a plurality of laser subsystems 200, each one of the laser subsystems 200 comprising an active optical fiber 240, wound in a shape of hollow coil and packaged inside a hollow cylindrical box 210, and at least one diode laser 220 mechanically connected perpendicularly to the hollow cylindrical box 210 and optically coupled to the core of the active optical fiber 240 wound and packaged inside the hollow cylindrical box 210, the laser module 310 having a tubular shape allowing cooling and drilling fluids to flow through the concentric hollow cores of the tubular laser module 310 and of the cylindrical box 210; and b) an optical drill head 100, the optical drill head comprising an end 130 with orifices 110 and 120, and a body 140, wherein:

i) the laser module is responsible for high intensity light generation that, through the optical fibers 320, is guided to the optical drill head 100;

ii) the laser module and the optical drill head 100 are coupled to a drill string;

iii) the orifices 110 are those through which high-power laser light leaves the optical drill head 100; and iv) the orifices 120 allow the exit of the cooling and drilling fluids that flow through the interior of the tubular laser module 310 and through the optical drill head 100.

The laser subsystems 200 can have geometrical features that allow the laser subsystems 200 to be packaged in pairs, one on top of another, inside the tubular core of the drill string. The end 130 of the optical drill head 100 can have any geometrical shape. In one embodiment, the end 130 of the optical drill head 100 can have a spherical shape.

The end 130 of the optical drill head 100 can be constructed to have a maximum angle of operation that controls the inclination that the well or wellbore can be drilled. The maximum angle of operation can have its vertex 131 at the geometrical center of the spherical drill head end 130 and can be formed by imaginary lines crossing this center, one 132 perpendicular to the symmetry axis 101 of the drill head and the other 133 aligned with the center of a cylindrical orifice 111 where a light beam can leave the drill head 100 end 130 at the direction that makes the maximum angle with the drill head 100 end 130 symmetry axis 101.

Another preferred embodiment of the invention can further comprise providing steering control of the drilling process, wherein the steering control is provided by the chosen shape of the end 130 of the optical drill head 100, wherein the angle that defines the maximum angle of operation of said drill head establishes the inclination 102 that can be reached for the drilled borehole.

Another preferred embodiment of the invention can further comprise provide, for each point of interaction between the laser light that leaves the optical drill head 100 end 130 and the rock surface to be drilled, an optical fiber 320 supplying beams of high intensity laser light. Each optical fiber 320 guiding light from the laser module 310 to the optical drill head 100 can be associated with at least one laser subsystem 200 or to multiple laser subsystems 200 whose single or combined emitted light has a suitable power level to drill the rock formation. The laser subsystems 200 that provide high power light for the drilling process can be embedded in a laser module 310 having a cylindrical tubular shape having an outer diameter equal to that of a standard drill pipe. Each one of the laser subsystems 200 embedded in the laser module 310 can be individually controlled and selectively turned on or off, or can have their optical power output increased or decreased, and, through the optical fibers 320 that guide high intensity light from the laser subsystems 200 to the optical drill head 100 end 130, can illuminate specific areas of the rock formation 140 surrounding the laser drilling device, thus enabling the control of the inclination of the drilled borehole.

In another preferred embodiment of the invention, the orifices 110 can be channels through which high intensity light beams leave the optical drill head 100 end 130 and where the optical fibers 320 or bundle of the optical fibers 320 that guide light from the laser subsystems 200 can be connected to said drill head 100 end 130 through an optical connector and lenses system 340, while the orifices 120 can be open to allow the outlet of drilling and cooling fluids, which flow through the drill string 410 and the laser drilling device 300 towards the rock surface to be drilled.

Each orifice 110 wherein the optical fibers 320 or bundle of the optical fibers 320 can be fixed and light beams leave the end 130 of the optical drill head 100 through an optical connector and lens system 340 that has a center axis oriented along a radial direction that crosses the geometric center 131 of the spherical end 130 of the optical drill head 100, thus ensuring that light beams leaving the device can focus perpendicularly to the surrounding rock surface 140 to be drilled.

The number of orifices 110 where optical fibers 320 or bundles of the optical fibers 320 are fixed and light beams leave the end 130 of the optical drill head 100 through an optical connector and lenses system 340 can be determined by considering the area of rock surface that can be individually drilled by each of the optical fibers 320 or bundle of the optical fibers 320 and the required superposition and combination of the individual light beams in order to illuminate and drill the whole area of rock 140 surrounding the end 130 of the optical drill head 100.

In another preferred embodiment of the invention, the optical drill head 100 is a mechanical component, wherein:

i) optical fibers 320 that guide high power laser light generated at the laser module 310 can be connected to optical connectors and lenses systems 340 fixed on the end 130;

ii) through the shape of the end 130 the optical drill head 100 can provide geometrical control and selectivity to the direction and areas of the surrounding rock 140 being illuminated by the laser light; and iii) the optical drill head 100 can promote the interface of said laser drilling device 300 with the rock formation to be drilled 140.

The mechanical and optical connection of the diode lasers 220 to the active fibers 240 wound in the hollow cylindrical box 210 can be effected by optimizing the space inside the tubular laser module 310 in order to allow the flow of a cooling and drilling fluid through the inner space inside the tubular laser module 310 and to intensify thermal dissipation of heat generated by the thermo-optical conversion process occurring in the diode lasers 220. The diode lasers 220 can be connected directly to the optical fibers 320 that guide the light from the laser module 310 to the optical drill head 100, eliminating the use of the active optical fiber in the laser subsystem 200.

Those skilled in the art will appreciate the teachings herein presented and will be able to reproduce the invention in the embodiments presented and in others variants, falling within the scope in the appended claims.

What is claimed is:

1. A device for laser drilling, comprising:

a) a laser module (310), comprised of a plurality of laser subsystems (200), each one of the laser subsystems (200) comprising an active optical fiber (240) having a core, wound in a shape of a hollow coil and packaged inside a hollow cylindrical box (210), and at least one diode laser (220) mechanically connected perpendicularly to the hollow cylindrical box (210) and optically coupled to the core of the active optical fiber (240) wound and packaged inside the hollow cylindrical box (210), the laser module (310) having a tubular shape allowing cooling and drilling fluids to flow through a hollow inner space of the tubular laser module (310) and of the cylindrical box (210); and b) an optical drill head (100), the optical drill head comprising an end (130) with orifices (110 and 120), and a body (140), wherein:

i) the laser module is responsible for high intensity light generation that, through optical fibers (320), is guided to the optical drill head (100);

ii) the laser module and the optical drill head (100) are coupled to a drill string;

iii) the orifices (110) are those through which high-power laser light leaves the optical drill head (100); and iv) the orifices (120) allow the exit of the cooling and drilling fluids that flow through the hollow inner space of the tubular laser module (310) and through the optical drill head (100).

2. The device for laser drilling according to claim 1, wherein the plurality of laser subsystems (200) have geometrical features that allow the plurality of laser subsystems (200) to be packaged in pairs, one on top of another, inside the tubular core of the tubular laser module (310).

3. The laser drilling device according to claim 1, wherein the end (130) of the optical drill head (100) has any geometrical shape.

4. The laser drilling device according to claim 1, wherein the end (130) of the optical drill head (100) has a spherical shape.

5. The laser drilling device according to claim 4, wherein the end (130) of the optical drill head (100) is constructed having a maximum angle of operation that controls the inclination that the well or wellbore can be drilled.

6. The laser drilling device according to claim 5, wherein the maximum angle of operation has its vertex (131) at the geometrical center of the spherical drill head end (130) and is formed by imaginary lines crossing this center, one (132) perpendicular to the symmetry axis (101) of the drill head and the other (133) aligned with the center of a cylindrical orifice (111) where a light beam leaves the drill head (100) end (130) at the direction that makes the maximum angle with the drill head (100) end (130) symmetry axis (101).

7. The laser drilling device according to claim 5, further comprising providing steering control of the drilling process, wherein the steering control is provided by the chosen shape of the end (130) of the optical drill head (100), wherein the angle that defines the maximum angle of operation of said drill head establishes the inclination (102) that can be reached for the drilled borehole.

8. The laser drilling device according to claim 1, further comprising providing, for each point of interaction between the laser light that leaves the optical drill head (100) end (130) and the rock surface to be drilled, one of the optical fibers (320) supplying beams of high intensity laser light.

9. The laser drilling device according to claim 1, wherein each of the optical fibers (320) guiding light from the laser module (310) to the optical drill head (100) is associated with at least one of the plurality of laser subsystems (200) whose emitted light has a suitable power level to drill the rock formation.

10. The laser drilling device according to claim 1, wherein the plurality of laser subsystems (200) that provide high power light for the drilling process are embedded the tubular laser module (310), and the tubular laser module (310) has an outer diameter equal to that of a standard drill pipe.

11. The laser drilling device according to claim 1, wherein each of the plurality of laser subsystems (200) is individually controlled and selectively turned on or off, or have their optical power output increased or decreased, and, through the optical fibers (320) that guide high intensity light from the plurality of laser subsystems (200) to the optical drill head (100) end (130), illuminate specific areas of the rock formation (140) surrounding the laser drilling device, thus enabling the control of the inclination of the drilled borehole.

12. The laser drilling device according to claim 1, wherein the orifices (110) are channels through which high intensity light beams leave the optical drill head (100) end (130) and where the optical fibers (320) or a bundle of the optical fibers (320) that guide light from the plurality of laser subsystems (200) are connected to the drill head (100) end (130) through an optical connector and lenses system (340), while the orifices (120) are open to allow the outlet of drilling and cooling fluids, which flow through the drill string (410) and the laser drilling device (300) towards the rock surface to be drilled.

13. The laser drilling device according to claim 1, wherein each of the orifices (110) wherein the optical fibers (320) or a bundle of the optical fibers (320) are fixed and light beams leave the end (130) of the optical drill head (100) through an optical connector and lens system (340) that has a center axis oriented along a radial direction that crosses the geometric center (131) of the spherical end (130) of the optical drill head (100), thus ensuring that light beams leaving the device focus perpendicularly to the surrounding rock surface (140) to be drilled.

14. The laser drilling device according to claim 1, wherein the number of the orifices (110) where the optical fibers (320) or bundles of the optical fibers (320) are fixed and light beams leave the end (130) of the optical drill head (100) through an optical connector and lenses system (340) is determined by considering the area of rock surface that can be individually drilled by each of the optical fibers (320) or the bundles of the optical fibers (320) and the required superposition and combination of the individual light beams in order to illuminate and drill the whole area of rock (140) surrounding the end (130) of the optical drill head (100).

15. The laser drilling device according to claim 1, wherein the optical drill head (100) is a mechanical component, wherein:

i) the optical fibers (320) that guide high power laser light generated at the laser module (310) are connected to optical connectors and lenses systems (340) fixed on the end (130);

ii) the end (130) of the optical drill head (100) has a shape that provides for geometrical control and selectivity of the optical drill head (100) relative to the direction and areas of the surrounding rock (140) being illuminated by the laser light; and iii) the optical drill head (100) promotes the interface of said laser drilling device (300) with the rock formation to be drilled (140).

16. The laser drilling device according to claim 1, wherein the mechanical and optical connection of the at least one diode laser (220) to the active optical fiber (240) wound in the hollow cylindrical box (210) are effected by optimizing the inner space the tubular laser module (310) in order to allow the flow of the cooling and drilling fluids through the inner space of the tubular laser module (310) and to intensify thermal dissipation of heat generated by the thermo-optical conversion process occurring in the at least one diode laser (220).

17. The laser drilling device according to claim 1, wherein the at least one diode laser (220) is connected directly to the optical fibers (320) that guide the light from the laser module (310) to the optical drill head (100), eliminating the use of the active optical fiber in the plurality of laser subsystems (200).

* * * * *